US011384490B2

(12) United States Patent
Rill

(10) Patent No.: US 11,384,490 B2
(45) Date of Patent: Jul. 12, 2022

(54) JOINT SEALING PROFILE, CONSTRUCTION JOINT BRIDGING DEVICE AND METHOD OF MANUFACTURING A JOINT SEALING PROFILE

(71) Applicant: MAURER ENGINEERING GMBH, Munich (DE)

(72) Inventor: Daniel Rill, Munich (DE)

(73) Assignee: MAURER ENGINEERING GMBH, Munich (DE)

( * ) Notice: Subject to any disclaimer, the term of this patent is extended or adjusted under 35 U.S.C. 154(b) by 44 days.

(21) Appl. No.: 16/765,965

(22) PCT Filed: Nov. 21, 2018

(86) PCT No.: PCT/EP2018/082106
§ 371 (c)(1),
(2) Date: May 21, 2020

(87) PCT Pub. No.: WO2019/101804
PCT Pub. Date: May 31, 2019

(65) Prior Publication Data

US 2020/0362523 A1 Nov. 19, 2020

(30) Foreign Application Priority Data

Nov. 23, 2017 (DE) ..... 10 2017 220 915.1

(51) Int. Cl.
*E01C 11/00* (2006.01)
*E01D 19/06* (2006.01)
(Continued)

(52) U.S. Cl.
CPC ..... *E01D 19/06* (2013.01); *E01C 11/02* (2013.01); *E01D 21/00* (2013.01); *E01D 22/00* (2013.01);
(Continued)

(58) Field of Classification Search
CPC ..... E01C 11/02; E01D 19/06; E01D 21/00; E01D 22/00; E04B 1/6806; E04B 1/681; E04B 2001/6818
(Continued)

(56) References Cited

U.S. PATENT DOCUMENTS 3,598,026 A * 8/1971 Johnson ..... E04B 1/6815 404/49
3,606,826 A * 9/1971 Bowman ..... E04B 1/6803 404/49
(Continued)

FOREIGN PATENT DOCUMENTS

BE 1 014 719 A3 3/2004
DE 41 04 402 A1 8/1992
(Continued)

OTHER PUBLICATIONS

Notification of Reason(s) for Refusal issued in Japanese Patent Application No. 2020-528126 dated Oct. 22, 2021, with English translation.
(Continued)

*Primary Examiner* — Raymond W Addie
(74) *Attorney, Agent, or Firm* — BakerHostetler

(57) ABSTRACT

A construction joint bridging device with a joint sealing profile and a joint sealing profile as such, as well as a method for producing a joint sealing profile and a method for producing and disassembling a construction joint bridging device. The joint sealing profile consisting at least partially of an elastic material and having a holding portion for fastening to the construction joint bridging device, wherein the holding portion has at least in sections a material composition which can be activated in a targeted manner by chemical, thermal and physical exposure so that the volume of the holding portion changes.

15 Claims, 2 Drawing Sheets

(51) Int. Cl.

| | |
|---|---|
| ***E01C 11/02*** | (2006.01) |
| ***E01D 21/00*** | (2006.01) |
| ***E01D 22/00*** | (2006.01) |
| *E04B 1/68* | (2006.01) |

(52) U.S. Cl.
CPC ..... *E04B 1/681* (2013.01); *E04B 1/6806* (2013.01); *E04B 2001/6818* (2013.01)

(58) Field of Classification Search
USPC ..... 404/47–49, 67, 72
See application file for complete search history.

(56) References Cited

U.S. PATENT DOCUMENTS

| | | | | | |
|---|---|---|---|---|---|
| 4,443,019 | A * | 4/1984 | Ishido | C09K 3/10 | 138/89 |
| 4,558,875 | A * | 12/1985 | Yamaji | C09K 3/10 | 106/DIG. 4 |
| 4,622,784 | A * | 11/1986 | Black | E04B 1/6806 | 404/64 |
| 4,740,404 | A * | 4/1988 | Otsugu | E01C 11/106 | 404/64 |
| 5,071,282 | A * | 12/1991 | Brown | E01C 11/126 | 404/68 |
| 6,164,618 | A * | 12/2000 | Yonemura | E03F 3/04 | 249/190 |
| 6,685,196 | B1 * | 2/2004 | Baerveldt | E01C 11/106 | 277/628 |
| 7,354,219 | B2 * | 4/2008 | Leonberg | E01D 19/06 | 14/73.5 |
| 7,381,768 | B2 * | 6/2008 | Wiercinski | C08L 33/02 | 428/35.2 |
| 2003/0134102 | A1 | 7/2003 | Wang et al. | | |
| 2015/0259861 | A1 * | 9/2015 | Spuler | E01C 11/16 | 404/68 |

FOREIGN PATENT DOCUMENTS

| | | | |
|---|---|---|---|
| DE | 41 14 507 | A1 | 11/1992 |
| EP | 0 304 225 | A1 | 2/1989 |
| GB | 2 205 872 | A | 12/1988 |
| JP | 9-143982 | A | 6/1997 |
| JP | 2001-247642 | A | 9/2001 |
| JP | 2001-342606 | A | 12/2001 |
| JP | 2002-500259 | A | 1/2002 |
| JP | 2002-180031 | A | 6/2002 |
| JP | 2005-350854 | A | 12/2005 |
| KR | 10-2004-0070245 | A | 8/2004 |
| KR | 10-0602217 | B1 | 7/2006 |
| KR | 20-0438688 | Y1 | 2/2008 |
| KR | 101 372 749 | B1 | 3/2014 |
| WO | 00/06846 | A1 | 2/2000 |
| WO | 2011/020601 | A1 | 2/2011 |

OTHER PUBLICATIONS

Notification of Reason(s) for Refusal issued in Korean Patent Application No. 10-2020-7018019 dated Nov. 4, 2021.
Second Substantive Examination Report issued in Chilean Patent Application No. 202001356 dated Jul. 14, 2021, with English translation.
Examination Search Report in Canadian Application No. 3,083,072 dated Jan. 13, 2022.

* cited by examiner

JOINT SEALING PROFILE, CONSTRUCTION JOINT BRIDGING DEVICE AND METHOD OF MANUFACTURING A JOINT SEALING PROFILE

CROSS-REFERENCE TO RELATED APPLICATIONS

This application is a National Stage of International patent application PCT/EP2018/082106, filed on Nov. 21, 2018, which claims priority to foreign German patent application No. DE 10 2017 220 915.1, filed on Nov. 23, 2017, the disclosures of which are incorporated by reference in their entirety.

FIELD OF THE INVENTION

The present invention relates to a joint sealing profile for a construction joint bridging device, which is elastic and has at least one holding portion for fixing it to the bridging device. The invention further relates to the use of a joint sealing profile in a construction joint bridging device with such a joint sealing profile. Furthermore, the invention relates to a method for manufacturing such a joint sealing profile.

BACKGROUND

Such joint sealing profiles are basically known for a long time and are used in different forms in various fields of application, for example for sealing roadway transitions or pavement transitions in bridges or generally for joints between construction parts. Particularly when gaps between structural elements are to be sealed against the ingress of moisture and/or dirt, the tight contact between the joint sealing profile and the construction joint bridging device is important for fulfilling the sealing function. Usually this contact is made via holding portions, such as thickened edges, which are formed on the joint sealing profile and which engage in recesses provided for this purpose on supports of the respective construction joint bridging device applied. The contact is created between the outer surface of the holding portion and the inner surface of the recess. The term holding portion is generally to be understood as a portion that is suitable for holding the joint sealing profile in position with a form- and/or force-locking fit.

The sealing of the connection of the joint sealing profile with the bridging device depends on the extent to which the holding portions are clamped in the designated recesses. This is influenced by the contact surface and the surface force generated on the pair of surfaces holding portion-outer surface and recess-inner surface. The more a holding portion is clamped in the recess, the greater the sealing effect. With conventional joint sealing profiles, an attempt is therefore made to maximise the deformation of the holding portion in the installed state. For this purpose, parts of the holding portion are made thicker than the space available in the recess. The disadvantage here, however, is that the installation and removal of the holding portion in the intended recess is made proportionally more difficult in relation to the deformation, since this very same deformation must be applied mechanically during installation and disassembly. This can lead to considerable installation effort, especially in the case of the usually narrow and only limitedly accessible recesses in the supports of the bridging device.

SUMMARY OF THE INVENTION

In view of this background, it is the object of the present invention to provide a joint sealing profile which can be more easily installed in a bridging device while maintaining or even improving the sealing performance.

The solution to the problem is achieved, as per the device, first of all with a joint sealing profile according to claim 1.

The joint sealing profile in accordance with the invention has the characteristic that the holding portion has at least in sections a material composition which can be activated in a targeted manner by a chemical, thermal and/or physical exposure so that the volume of the holding portion changes.

The invention is thus based on the findings that the thickening of the holding portion, which has been common up to now, does not have to permanently exist. Rather, it is sufficient if this volume is only created specifically when the joint sealing profile is inserted into the relevant recess or the thickening can be specifically reversed for removal. This has the decisive advantage that the shape of the holding portion can be designed much more freely from installation conditions (such as opening cross-section of the recess, accessibility of the joint with tools, ergonomics, etc.). It also has the advantage that the sealing associated with the change in volume can be specifically activated or deactivated at any time. This activation can generally occur passively or actively, once or several times and, if necessary, gradually or in steps increasing or decreasing. The material composition can be understood as an individual substance, a mixture of substances, a substance intercalation, a substance accumulation or a chemical compound of several substances. In the broadest sense, exposure is to be understood as bringing the material composition into contact with or into the area of action of the means of exposure.

In this context, the chemical exposure should generally be understood as the initiation and/or acceleration of a chemical reaction, in particular as the addition of a reactant or a catalyst. This can have different states of aggregation and be present as a chemical element, as a compound or as a mixture of compounds. The addition can take place by means of various transport processes, for example by means of a fluid-mechanical or mechanical flow of substances or by diffusion processes. The term "thermal addition" should be understood as heat flow into the material composition. Nevertheless, this term also includes a heat flow out of the material composition. The term "physical exposure" shall describe any kind of physical action such as material or non-material exposure. A material exposure is to be understood in the broadest sense as the addition of material, which changes the volume of the holding portion by its presence. Also included is radiation of particles. Also included are pressure waves, sound waves and the like. Non-material exposure is also conceivable, such as energetic, field-based or wave/particle-type exposure. Examples include magnetic fields, electric fields, electric waves, light waves and other energy flows.

The wording "to change the volume" does not necessarily require an externally perceptible change in volume of the holding portion when installed. Under certain circumstances, in the actual installation situation, the outer surface of the holding portion may already be completely in contact with the inner surface of the recess, which precludes a volumetric change of the holding portion. In such a case, the change in volume of the holding portion due to activation is determined in the disassembled state.

It is advisable for the volume change to be an increase in volume. This has the advantage that the holding portion can form a form-fitting connection in the activated state if the recess has a corresponding undercut, for example in the form of a recessed step or claw. This secures the holding portion in the recess.

Thereby it is useful if the volume change is at least partially reversible. This reversal of the change in volume can be caused, for example, by a new activation, which then reverses the volume change of the holding portion. Alternatively, the inversion can occur due to the fact that the exposure is interrupted. The latter may be the case, for example, if the change in volume requires the application of an electric field or a flow of energy. If the electric field is removed or the flow of energy is interrupted, the change in volume will also reverse. The joint sealing profile can therefore be removed more easily once the volume change has receded by a certain amount.

It is advisable for the material composition located in the holding portion to have a material swellable by a liquid, so that the exposure can be effected with such a liquid. It is advantageous here that a liquid can be easily applied and, for example, even in narrow installation situations, can reach the areas to be exposed due to capillary forces. In addition, a liquid can easily drain out of shrinking cavities between the holding portion and the recess during the change in volume of the holding portion, whereby possible residues of the medium of exposure can be avoided as far as possible.

Further, the swellable material includes a mineral and/or a water-swellable polymer. The exposure occurs thereby with water or a water-containing liquid. The decisive advantage here is that the sealing effect of the joint sealing profile against water, such as rainwater, can be activated or reinforced by this medium itself. Another advantage is that water has particularly good flow and wetting properties, which makes it easier to act on the holding portion.

Advantageously, the swellable material includes a granulate with a polyacrylic acid-based superabsorber and an elastomeric carrier material. The term superabsorber refers to a particularly absorbent material composition. The granulate can be mixed with the elastomeric carrier material. The composite of superabsorber and carrier material has the advantage that an optimum mix can be produced that meets both structural material requirements, such as compressive strength, mechanical resistance and/or chemical stability, as well as swellability-related material requirements.

It can also be advantageous if the material composition contains a material that increases its volume when exposed to a chemical, so that the exposure can occur with such a chemical. This may be advantageous in order to avoid accidental or unintentional activation to increase the volume of the holding portion. In this case, the activation can be understood as encrypted in the sense that it only occurs when the correct chemical is applied to the holding portion. This reduces the risk of unauthorized activation or deactivation. It can also prevent unintentional environmental influences from causing the holding portion to be activated.

In addition, the material composition can contain a prepolymer, so that the exposure can occur by means of water, whereby the prepolymer is designed to release CO2 depending on the swelling. Ideally, the prepolymer is first sealed airtight in the holding portion of the joint sealing profile. The prepolymer can be activated by exposing it to ambient air, e.g. by breaking the seal, and thus coming into contact with water. As is well known from the field of installation foams, the prepolymer reacts with water to form a stable foam with a significant and permanent increase in volume. The fully developed foam is largely resistant to environmental influences. Water can be applied in a gaseous aggregate state, and/or in a liquid aggregate state in the form of liquid water or water droplets, and/or in a solid aggregate state.

Furthermore, it can be advantageous if the material composition contains a field-affine material, so that the exposure can occur by applying a field. The term "field-affine" is to be generally understood in such a way that the material has the property of being influenced by the said field in a way that can cause a change in volume of the holding portion. For example, the material may have ferromagnetic properties and the field may be a magnetic field. When a magnetic field is applied, the position or distribution of the material in the holding portion can change, which can change the volume of the material. Thereby the magnetic field can be electrically or magnetically induced.

Alternatively and/or additionally, the field can be an electric field which, when applied, changes the electric charge of the field-affine material, whereupon it is influenced in such a way that a change in volume of the holding portion is caused. Such a field-based activation in combination with a field-affine material has the advantage that the field-affine material can be present in the holding portion of the joint sealing profile without any material exchange with the environment. In this case, the exposure itself is best achieved via energy flows. A further advantage is the possibility to flexibly switch the exposure on and off and to adjust its intensity to the desired level. This is particularly advantageous for temporary sealing applications that only need to seal for a certain period of time.

The object of the invention is further solved by means of the use of a joint sealing profile in a construction joint bridging device according to claim 10 with a joint sealing profile according to the invention, wherein the construction joint bridging device includes at least one support with a recess for receiving a holding portion of the joint sealing profile. The support is purposefully designed as a profile. It serves to connect the bridging device or the profile to the construction. Usually, the respective support itself is anchored in the associated construction body by means of an anchor construction.

Preferably, the holding portion is designed in such a way that when it is subjected to chemical, thermal and/or physical exposure, it forms an abutting contact with the corresponding recess (A). Advantages resulting from such an abutting contact are, on the one hand, the resulting adhesion of the bodies to each other and, on the other hand, that a sealing effect is created at each abutting contact.

Preferably, the holding portion upon exposure forms a form-fitting component connection with the corresponding recess. The recess can thus have a recessed step or generally an undercut into which the holding portion extends in the installed state after exposure.

Alternatively or in addition, the holding portion upon exposure forms a force-locking component connection with the corresponding recess. An advantage of the frictional connection is the additional sealing function.

The object underlying the invention is further solved by a method for producing a joint sealing profile, whereby the material composition is introduced into the profile in the holding portion. The manufacture of the profile can, for example, be done by means of coextrusion. Thus, a profile can have a hollow space in the holding portion into which the material composition is introduced. It is advantageous here that the manufacturing process of a joint sealing profile according to the invention is then largely identical to the manufacturing process of a conventional joint sealing profile. Chemically, thermally and/or physically activatable material compositions could then be introduced into the otherwise conventionally manufactured profile in a subsequent process step.

In a further development, at least part of the holding portion is manufactured with the material composition as a separate component and is connected as such to the profile in a separate process step. This also includes a process in which material in the holding portion, or the holding portion as such, is removed and a further component which contains or embodies the material composition is connected to the joint sealing profile. This allows a simple, cost- and material-saving production of a joint sealing profile according to the invention.

In further developments, it can be advantageous if the separate component is vulcanised onto the profile. An advantage of vulcanization is the resistant component connection of the vulcanized components.

The objective underlying the invention is further solved by a method for producing a construction joint bridging device with a joint sealing profile according to claim 16, wherein the joint sealing profile is inserted into the recess and the holding portion is subjected to chemical, thermal and/or physical exposure so that its volume increases. As a result, the volume change of the holding portion necessary for the functional performance of the construction joint bridging device is activated with a time delay, namely only after the installation of the joint sealing profile. This allows it to be installed without any particular effort and in an ergonomically advantageous way. Another advantage is that the volume change in the holding portion can be designed completely independently of the gap dimensions available for installation.

Furthermore, the objective underlying the invention is solved by a method for disassembling a construction joint bridging device with a joint sealing profile according to claim 17, wherein the chemical, thermal and/or physical exposure to the holding portion of the joint sealing profile inserted into the recess is changed in such a way that the volume of the holding portion is reduced. Analogous to the variants with regard to the installation of the joint sealing profile, the volume reduction of the holding portion has the advantage that the joint sealing profile can be removed again without special effort. The term "changed" in this context means an intended change of the exposure. This can mean, for example, the interruption or weakening of a constantly present exposure. Otherwise, this can also mean that the joint sealing profile is exposed to a new substance which causes the holding portion of the joint sealing profile to reduce its volume.

BRIEF DESCRIPTION OF THE DRAWINGS

In the following, the invention is explained in more detail by means of two exemplified embodiments shown in the drawings. Therein, it is schematically show in.

DETAILED DESCRIPTION

Figure 1:
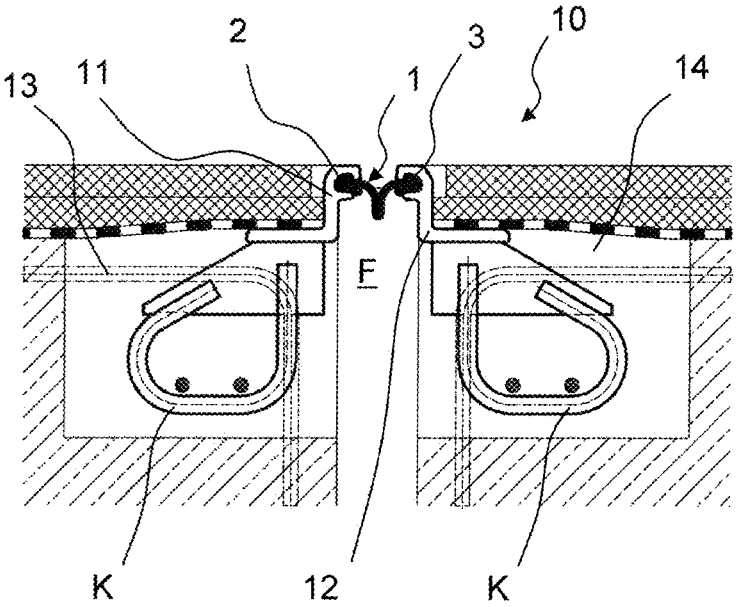
FIG. 1 a cross-section of a first embodiment of a construction joint bridging device with a joint sealing profile according to the invention.

The construction joint bridging device 10 shown in FIG. 1 is used to bridge or seal a joint F located between two parts of a construction. For this purpose, the construction joint bridging device 10 has a joint sealing profile 1 extending over the joint F. The joint sealing profile 1 in turn has a left holding portion 2 and a right holding portion 3. According to the illustration in FIG. 1, the left holding portion 2 is inserted in a left support 11 of the construction joint bridging device 10 and accordingly the right holding portion 3 is inserted in a right support 12 of the construction joint bridging device 10. The left support 11 as well as the right support 12 are each firmly connected with the corresponding left component 13 and the right component 14. For this purpose, the construction joint bridging device 10 in the shown example has an anchor construction K on each side of the joint F, by means of which the respective support is anchored to the construction.

Figure 2:
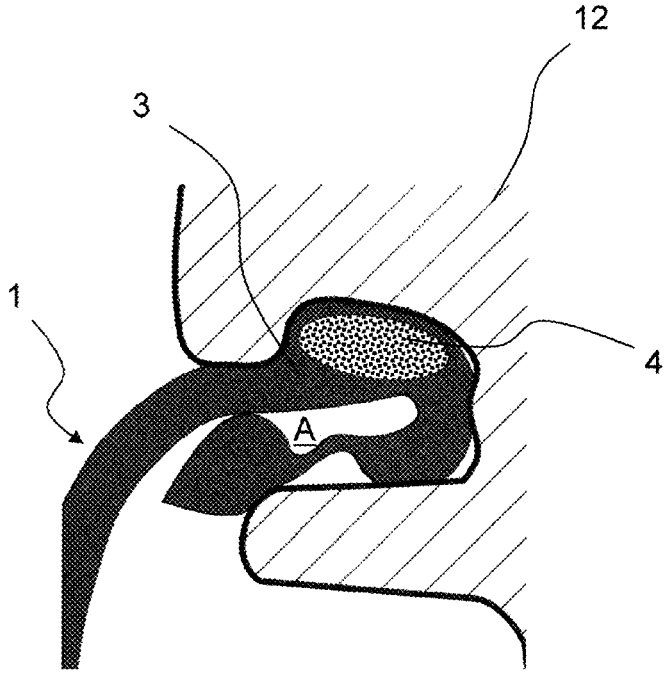
FIG. 2 an enlarged section of the cross-section shown in FIG. 1 in the activated state.

FIG. 2 shows an enlarged section of the construction joint bridging device 10 shown in FIG. 1, namely the right holding portion 3 of the joint sealing profile 1 as it is in engagement with the right support 12 of the construction joint bridging device 10. The holding portion has a material composition 4 which is in an activated state. According to the invention, the material composition is designed in such a way that its volume and thus also the volume of the right holding portion 3 increases after activation. As a result, the right holding portion 3 nestles almost completely against the inner wall of the recess A of the right support 12. The material composition is dosed in such a way that, in a non-installed situation, the holding portion 3 would expand significantly beyond the volume available in recess A after activation. This ensures that in the installed situation not only a surface contact is established but also that a substantial surface pressure can be generated between holding portion 3 and recess A in the activated state. It is precisely this surface pressure that can create a good sealing effect between the support 12 and the joint sealing profile 1.

Figure 3:
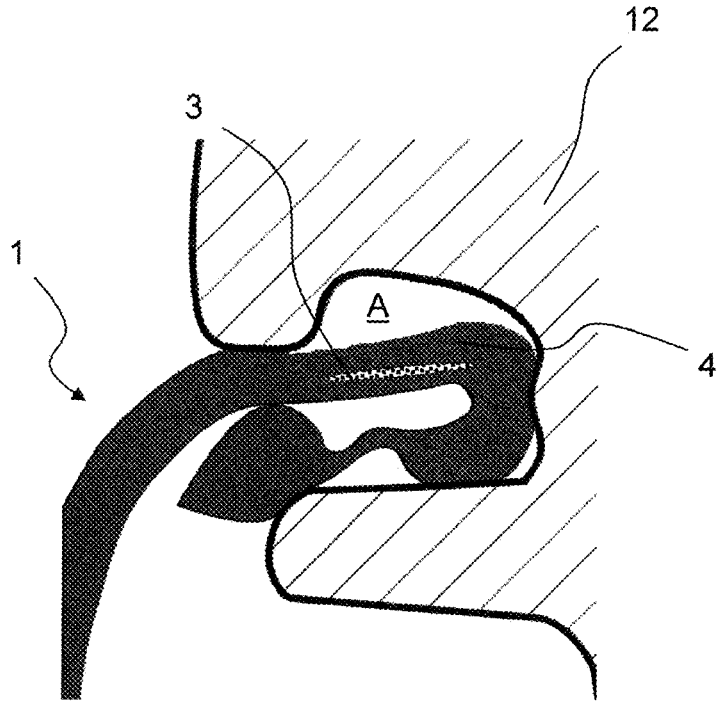
FIG. 3 a partial view of a construction joint bridging device as a cross-sectional view with a joint sealing profile according to a first embodiment in the non-activated state.

In FIG. 3 the same section of the construction joint bridging device is shown as in FIG. 2, but here the material composition 4 is in a non-activated state. This is thus the situation when the profile is inserted into recess A of support 12 or when it is removed. It can be seen that the right holding portion 3 has a smaller cross-section in contrast to the activated state, which results in the holding portion being easily inserted into or removed from the opening of the recess. When inserting or removing holding portion 3 into recess A, the holding portion must be deformed only slightly or, if applicable, not at all. After activation, however, the holding portion 3 in recess A is held both frictionally and form-fittingly in recess A, since after activation of the holding portion, it creates a claw-like undercut.

Figure 4:
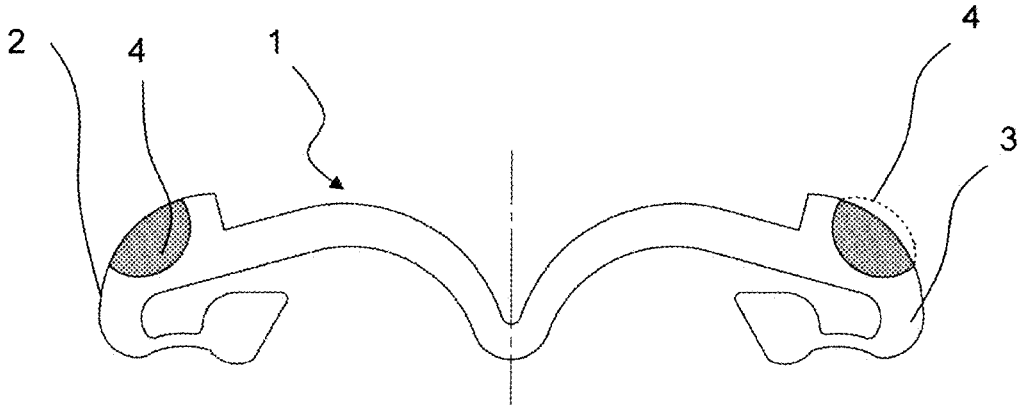
FIG. 4 a cross-section of a second embodiment of a joint sealing profile according to the invention.

The second embodiment of the joint sealing profile according to the invention shown in FIG. 4 has a left holding portion 2 and a right holding portion 3, with a shape that is adapted to the shape of the recess in the support, see FIGS. 1 to 3. The material composition 4 that can be activated is also arranged in holding portions 2 and 3, as in the first embodiment. In the figure shown in FIG. 4, the shape of the holding portion after activation of the fabric composition 4 is indicated by dashed lines on the right holding portion 3. The material composition 4 at the left holding portion 3 is shown in the non-activated state.

LIST OF REFERENCE SIGNS

A Recess
F Joint
K Anchor construction
1 Joint sealing profile
2 Left holding portion

3 Right holding portion
4 Material composition
10 Joint bridging device
11 Left support
12 Right support
13 Left component
14 Right component

The invention claimed is:

1. A construction joint bridging device for sealing roadway transitions or pavement transitions in bridges, wherein the construction joint bridging device comprises at least two supports and at least one joint sealing profile, wherein the joint sealing profile consisting at least partially of an elastic material and having at least one holding portion for fastening to the support of the construction joint bridging device, wherein each support comprises a recess of fixed volume for receiving at least one holding portion of the joint sealing profile, wherein the recess comprises an undercut into which the holding portion extends when activated, wherein at least one holding portion of the joint sealing profile is inserted into the recess, and the holding portion has, at least in sections, a material composition which can be activated in a targeted manner by a chemical, thermal, or physical exposure so that the volume of the holding portion increases, in order to form a form-fitting and force-locking component connection between the holding portion and the respective recess.

2. The construction joint bridging device according to claim 1, wherein the increase in volume is at least partially reversible.

3. The construction joint bridging device according to claim 1, wherein the material composition comprises a material which increases its volume upon exposure to a chemical.

4. The construction joint bridging device according to claim 1, wherein the material composition comprises a field-affine material, so that the exposure can occur by applying an energy field.

5. The construction joint bridging device according to claim 1, wherein the holding portion is designed in such a way that when it is subjected to chemical, thermal, and physical exposure, it forms an abutting contact with the corresponding recess.

6. The construction joint bridging device according to claim 1, wherein the material composition comprises a material swellable by a liquid, so that the exposure can occur by means of such a liquid.

7. The construction joint bridging device according to claim 6, wherein the swellable material comprises a mineral and a water-swellable polymer.

8. The construction joint bridging device according to claim 6, wherein the swellable material comprises a granulate comprising a polyacrylic acid-based superabsorber and an elastomeric carrier material.

9. The construction joint bridging device according to claim 6, wherein the material composition comprises a prepolymer so that the exposure can occur by means of water, wherein the prepolymer is configured to release CO2 depending on the swelling.

10. A method for producing a construction joint bridging device according to claim 1, wherein the joint sealing profile is produced as a profile and the material composition is introduced into the profile in the holding portion.

11. The method according to claim 10, wherein the joint sealing profile is inserted into the recess and the holding portion is subjected to chemical, thermal, and physical exposure so that its volume increases.

12. The method according to claim 10, wherein at least part of the holding portion is manufactured with the material composition as a separate component and is connected as such to the profile in a separate process step.

13. The method according to claim 12, wherein the separate component is vulcanized onto the profile.

14. A method of sealing joint in a construction joint bridging device using of a joint sealing profile, wherein the joint sealing profile consists at least partially of an elastic material and having at least one holding portion for fastening to a support of the construction joint bridging device, wherein each support comprises a recess of fixed volume for receiving at least one holding portion of the joint sealing profile, wherein the recess comprises an undercut into which the holding portion extends when activated, and the holding portion has, at least in sections, a material composition which can be activated in a targeted manner by a chemical, thermal, or physical exposure so that the volume of the holding portion increases, the method comprising:

inserting at least one holding portion of the joint sealing profile into the recess; and activating the holding portion in a targeted manner by a chemical, thermal, or physical exposure so that the volume of the holding portion increases so that the volume of the holding portion increases, in order to form a form-fitting and force-locking component connection between the holding portion and the respective recess.

15. A method for disassembling a construction joint bridging device for sealing roadway transitions or pavement transitions in bridges, wherein the construction joint bridging device comprises at least two supports and at least one joint sealing profile, wherein the joint sealing profile consisting at least partially of an elastic material and having at least one holding portion for fastening to the support of the construction joint bridging device, wherein each support comprises a recess of fixed volume for receiving at least one holding portion of the joint sealing profile, wherein the recess comprises an undercut into which the holding portion extends when activated, wherein at least one holding portion of the joint sealing profile is inserted into the recess, and the holding portion has, at least in sections, a material composition which can be activated and/or deactivated in a targeted manner by a chemical, thermal, or physical exposure so that the volume of the holding portion is reduced, the method comprising reducing a volume of the holding portion in target manner by chemical, thermal, or physical exposure.

* * * * *